US011184958B2

(12) United States Patent
Garcia-Polanco et al.

(10) Patent No.: US 11,184,958 B2
(45) Date of Patent: Nov. 23, 2021

(54) MICROWAVE OVEN GRILLING APPARATUS WITH HIGH EFFICIENCY HONEYCOMB PATTERN SCREEN

(71) Applicant: WHIRLPOOL CORPORATION, Benton Harbor, MI (US)

(72) Inventors: Nelson R. Garcia-Polanco, Besozzo (IT); John P. Doyle, Brunello (IT)

(73) Assignee: Whirlpool Corporation, Benton Harbor, MI (US)

( * ) Notice: Subject to any disclaimer, the term of this patent is extended or adjusted under 35 U.S.C. 154(b) by 233 days.

(21) Appl. No.: 16/309,192

(22) PCT Filed: Sep. 15, 2016

(86) PCT No.: PCT/US2016/051924
§ 371 (c)(1),
(2) Date: Dec. 12, 2018

(87) PCT Pub. No.: WO2018/052426
PCT Pub. Date: Mar. 22, 2018

(65) Prior Publication Data

US 2019/0268977 A1 Aug. 29, 2019

(51) Int. Cl.
*H05B 3/68* (2006.01)
*H05B 6/64* (2006.01)
*H05B 6/76* (2006.01)

(52) U.S. Cl.
CPC ..... *H05B 3/68* (2013.01); *H05B 6/64* (2013.01); *H05B 6/6402* (2013.01); *H05B 6/6482* (2013.01); *H05B 6/76* (2013.01)

(58) Field of Classification Search
CPC ..... H05B 3/68; H05B 6/76; H05B 6/6482; H05B 6/6402
(Continued)

(56) References Cited

U.S. PATENT DOCUMENTS 4,761,529 A * 8/1988 Tsisios ..... F24C 7/04 219/685
6,153,867 A 11/2000 Lee
(Continued)

FOREIGN PATENT DOCUMENTS

CN 105283105 1/2016
CN 205017622 U 2/2016
(Continued)

*Primary Examiner* — Thien S Tran
(74) *Attorney, Agent, or Firm* — Price Heneveld LLP

(57) ABSTRACT

A microwave oven is provided including a cooking cavity for receiving food to be cooked, at least one microwave source for generating microwave energy inside the cooking cavity, and a supplemental heating system positioned to heat the food. The supplemental heating system includes at least one IR radiation source for generating IR radiation and a metallic mesh screen placed between the at least one IR radiation source and the cooking cavity for spatially distributing the IR radiation to uniformly project into the cooking cavity and minimizing microwave energy field losses. The metallic mesh screen includes a plurality of hexagonal apertures arranged in a honeycomb pattern. The distance between parallel sides of each one of the hexagonal apertures is Ax and the distance between each hexagonal aperture and each adjacent hexagonal aperture is Bx where Ax is less than or equal to about 3 times Bx.

20 Claims, 6 Drawing Sheets

(58) Field of Classification Search
USPC ..... 219/528, 679, 681, 685
See application file for complete search history.

(56) References Cited

U.S. PATENT DOCUMENTS

| | | | | |
|---|---|---|---|---|
| 6,348,676 | B2 | 2/2002 | Kim et al. | |
| 6,900,422 | B2 | 5/2005 | Herold et al. | |
| 8,487,224 | B2 | 7/2013 | Choi et al. | |
| 2004/0020920 | A1* | 2/2004 | Herold ..... | H05B 6/766 219/679 |
| 2011/0297671 | A1 | 12/2011 | Nordh et al. | |
| 2011/0297672 | A1* | 12/2011 | Niklasson ..... | H05B 6/6402 219/702 |
| 2016/0120362 | A1 | 5/2016 | Fields et al. | |

FOREIGN PATENT DOCUMENTS

| | | | |
|---|---|---|---|
| CN | 205137572 | U | 4/2016 |
| EP | 0226343 | A2 | 6/1987 |
| EP | 0251539 | A1 | 6/1987 |
| GB | 2353897 | A | 3/2001 |
| GB | 2353897 | A * | 7/2001 |

* cited by examiner

MICROWAVE OVEN GRILLING APPARATUS WITH HIGH EFFICIENCY HONEYCOMB PATTERN SCREEN

BACKGROUND

The present device generally relates to a cooking apparatus, and more specifically, to a microwave oven having a supplemental heating system for grilling and broiling.

SUMMARY

In at least one aspect, a cooking apparatus is provided comprising a cooking cavity for receiving food to be cooked and a heating system positioned to heat the food disposed in the cooking cavity. The heating system comprising at least one IR radiation source for generating IR radiation that is projected into the cooking cavity and a metallic mesh screen placed between the at least one IR radiation source and the cooking cavity for spatially distributing the IR radiation to uniformly project into the cooking cavity. The metallic mesh screen includes a plurality of hexagonal apertures arranged in a honeycomb pattern, wherein the distance between parallel sides of each one of the hexagonal apertures is Ax and the distance between each hexagonal aperture and each adjacent hexagonal aperture is Bx, and wherein Ax is less than or equal to about 3 times Bx.

In at least another aspect, a microwave oven is provided comprising: a cooking cavity for receiving food to be cooked; at least one microwave source for generating microwave energy inside the cooking cavity to cook the food; and a supplemental heating system positioned to heat the food disposed in the cooking cavity. The supplemental heating system comprising at least one IR radiation source for generating IR radiation that is projected into the cooking cavity; and a metallic mesh screen placed between the at least one IR radiation source and the cooking cavity for spatially distributing the IR radiation to uniformly project into the cooking cavity and minimizing microwave energy field losses. The metallic mesh screen includes a plurality of hexagonal apertures arranged in a honeycomb pattern, wherein the distance between parallel sides of each one of the hexagonal apertures is Ax and the distance between each hexagonal aperture and each adjacent hexagonal aperture is Bx, and wherein Ax is less than or equal to about 3 times Bx.

These and other features, advantages, and objects of the present device will be further understood and appreciated by those skilled in the art upon studying the following specification, claims, and appended drawings.

DETAILED DESCRIPTION OF EMBODIMENTS

Figure 1:
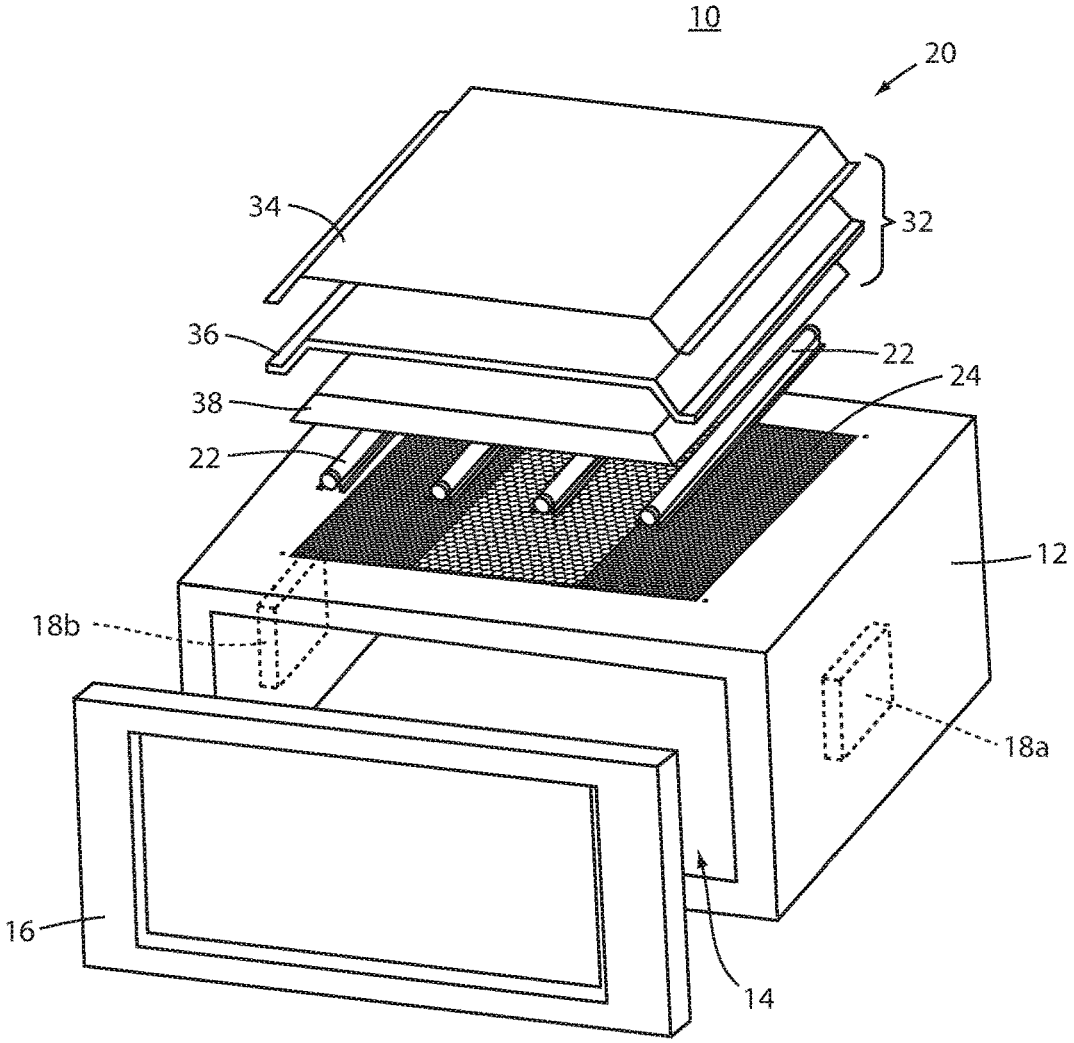
FIG. 1 is a an exploded view of a microwave oven having the heating system according to one embodiment.

For purposes of description herein the terms "upper," "lower," "right," "left," "rear," "front," "vertical," "horizontal," and derivatives thereof shall relate to the device as oriented in FIG. 1. However, it is to be understood that the device may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

As noted above, the embodiments described herein pertain to a cooking apparatus, and more particularly to a microwave oven having an additional heating system for grilling and broiling. In microwave ovens, grilling-browning devices of various kinds are often incorporated in order to allow cooking or heating of food in such a way that a crusty surface is obtained on the food, i.e., such that a browning effect is achieved. Examples of such microwave ovens are disclosed in commonly-assigned U.S. Pat. Nos. 6,153,866 and 6,946,631. Radiant heat is produced by a tube radiating infrared (IR) radiation. Such a tube may, for example, be a quartz tube. The IR radiation falling on the food is, in some ovens, increased by means of a reflector that is arranged above/behind the radiating tube. The IR radiation emitted by the lamps passes through a protective screen to irradiate the cooking cavity to grill food placed therein. One problem encountered in connection with this kind of browning device is that the lamps tend to produce a non-uniform spatial distribution of intensity of IR radiation and this can cause disadvantages. For instance, if the lamps are used for grilling or browning, the non-uniform spatial distribution of intensity can cause non-uniform grilling or browning of the food.

Referring to the embodiment illustrated in FIG. 1, reference numeral 10 generally designates a cooking apparatus, and more specifically a microwave oven. The microwave oven 10 includes a cabinet 12 having a cooking cavity 14 for receiving food to be cooked, a door 16, and at least one microwave source 18*a*, 18*b* for generating microwave energy within the cooking cavity 14 to cook the food disposed therein. The microwave oven 10 includes a supplemental heating system 20 positioned to heat the food placed in the cooking cavity 14. The supplemental heating system 20 includes at least one IR radiation source 22 for generating IR radiation that is projected into the cooking cavity 14, and a metallic mesh screen 24 placed between the at least one IR radiation source 22 and the cooking cavity 14 for spatially distributing the IR radiation to uniformly project into the cooking cavity 14 and minimizing microwave energy field losses. As described further below with respect to FIGS. 4A, 4B, 5, and 6, the metallic mesh screen 24 includes a plurality of hexagonal apertures 26 arranged in a honeycomb pattern 28. As specifically shown in FIG. 6, the distance between sides of each hexagonal aperture 26 is Ax and the distance between each hexagonal aperture 26 and each adjacent hexagonal aperture is Bx, and wherein Ax is less than or equal to about 3 times Bx.

The hexagonal shape of the apertures 26 of the screen 24, which are arranged in the honeycomb pattern 28 improves the system performance because it increases the amount of IR radiation passing through the screen 24 compared to a circular shape, while containing the microwave leaks.

Figure 2:
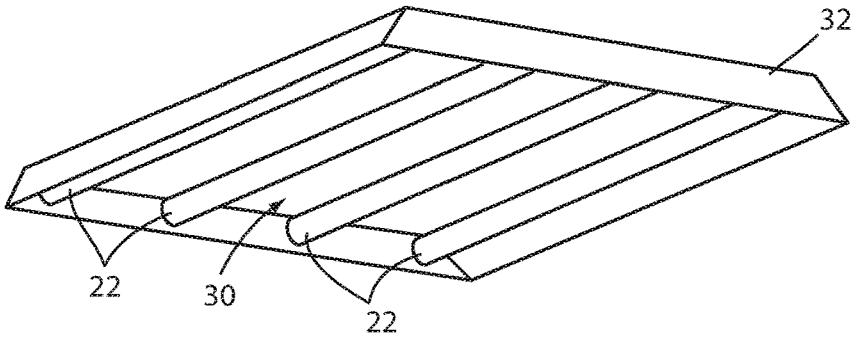
FIG. 2 is a perspective view of the heating system shown in FIG. 1.
Figure 3:
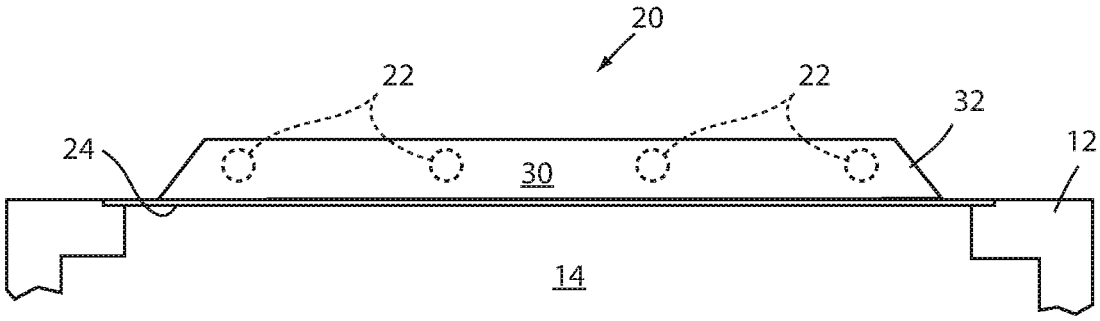
FIG. 3 is a partial side view of the microwave oven of FIG. 1.

The supplemental heating system 20 may be positioned in the ceiling of the cooking cavity 14. As shown in FIGS. 2 and 3, a cover 32 is provided that together with metallic mesh screen 24 defines a grilling compartment (grilling cavity) 30 that includes the IR sources 22, which may be quartz lamps that emit IR radiation. The metallic mesh screen 24 with its honeycomb pattern acts as a special highly efficient protective screen and placed in close proximity to the lamps. By forming the metallic mesh screen 24 in the manner as described herein, microwave propagation properties of screen 24 are such that the grilling cavity 30 becomes essentially microwave energy free. This eliminates power loss and protects the IR sources 22 from damage due to exposure to the microwave energy.

As shown in FIG. 1, the cover 32 may include a metal sheet 34, an insulation layer 36, and a reflective layer 38. The metal sheet 34 may be made of steel and the reflective layer 38 may be made of aluminum or another material that is highly reflective of the IR radiation emitted from IR sources 22.

Metallic mesh screen 24 may be made of high temperature austenitic stainless steel. In addition to uniformly spatially distributing the IR radiation from IR sources 22 and blocking microwave energy from passing through, metallic mesh screen 24 also protects users from contacting IR sources 22 and possibly burning themselves. The hexagonal apertures 26 may be formed by perforating a metal sheet.

Figure 4A:
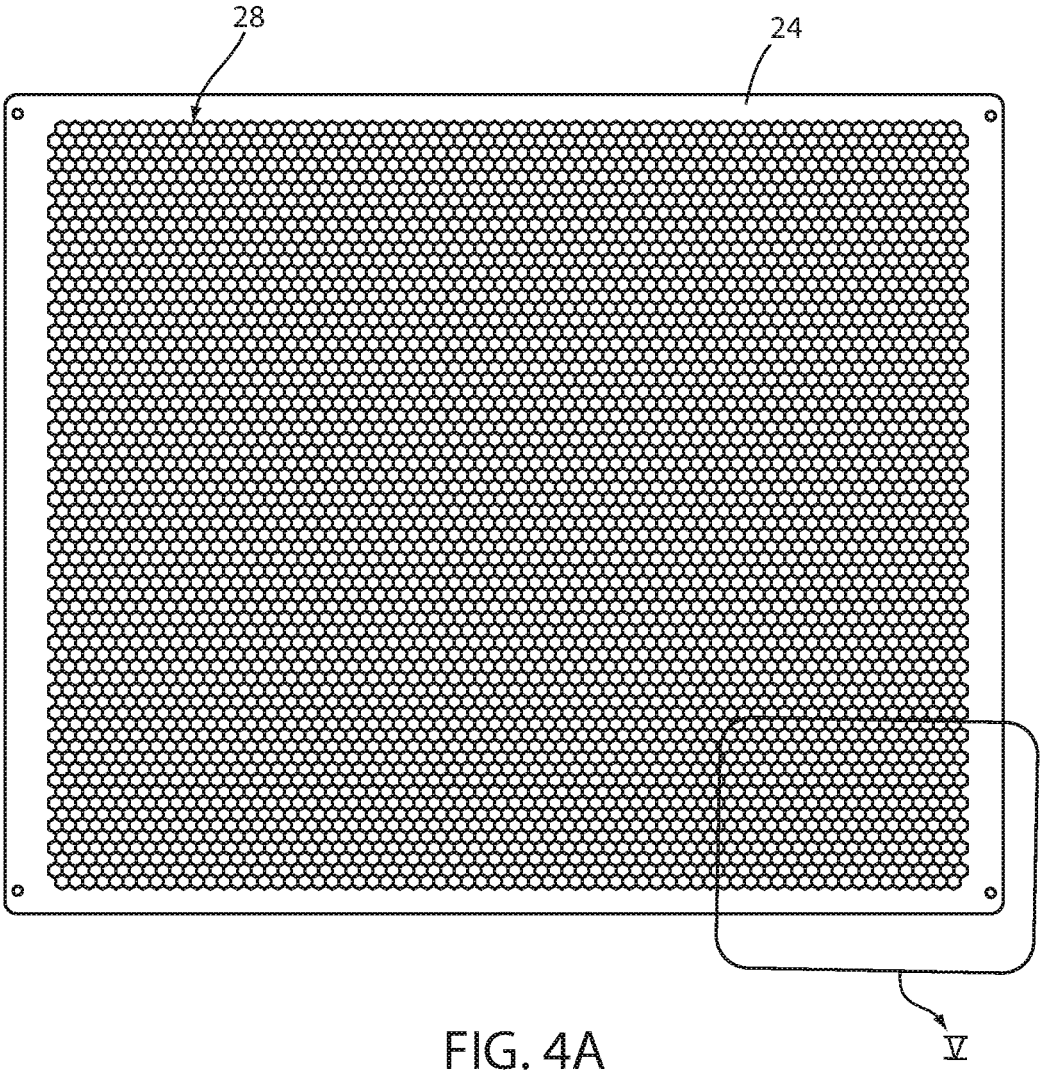
FIG. 4A is a plan view of a honeycomb pattern screen that may be used in the heating system of FIGS. 1 and 2.
Figure 5:
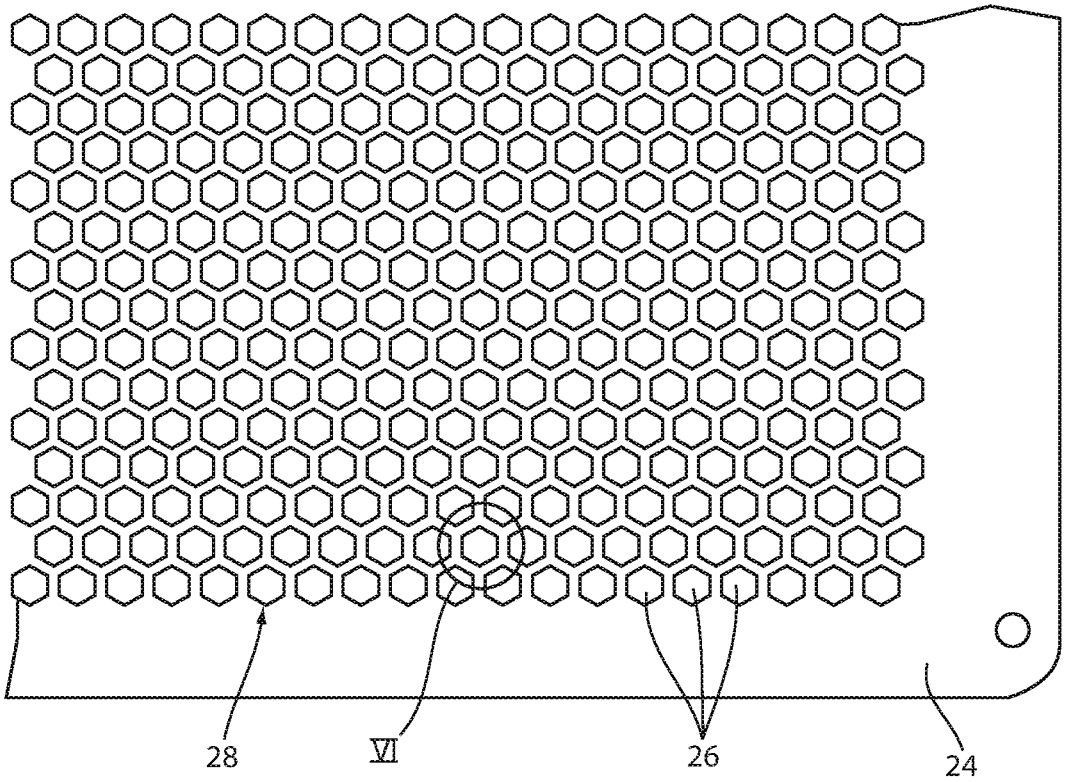
FIG. 5 is an enlarged view of a portion of the honeycomb pattern screen shown in FIG. 4A.
Figure 6:
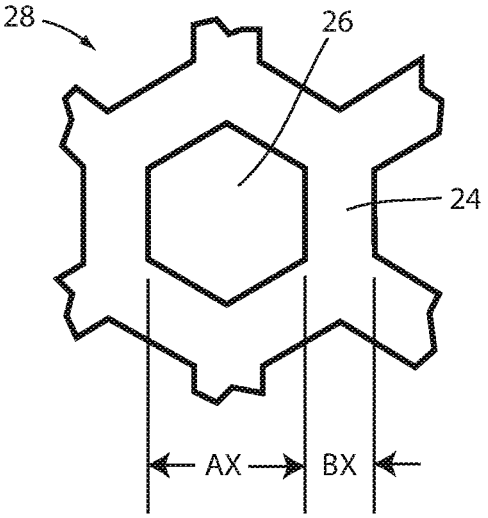
FIG. 6 is an enlarged view of a portion of the honeycomb pattern shown in FIG. 5.

An example of a metallic mesh screen 24 is shown in FIG. 4A. An enlarged view of area V of FIG. 4A is shown in FIG. 5 and an enlarged view of area VI of FIG. 5 is shown in FIG. 6. In this example shown in FIG. 4A, the honeycomb pattern 28 is uniformly distributed across the screen 24. With reference to FIG. 6, the distance between parallel sides of each one of the hexagonal apertures 26 is Ax and the distance between each hexagonal aperture 26 and each adjacent hexagonal aperture is Bx, wherein Ax is less than or equal to about 3 times Bx. Ax may be equal to 3 times Bx. Thus, for example, Bx may be 0.67 mm to 1.33 mm and Ax may be 2 mm to 4 mm. The metallic mesh screen 24 may have a thickness of about 1 mm to about 3 mm.

Figure 4B:
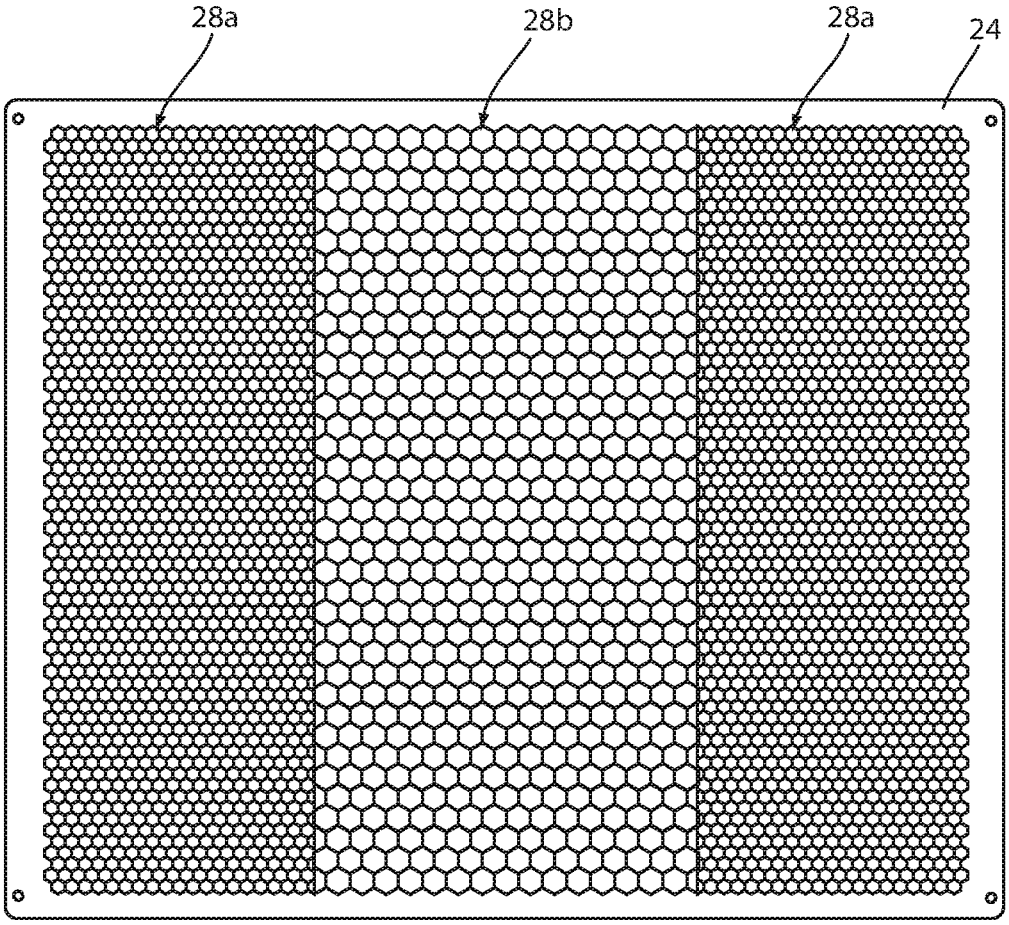
FIG. 4B is a plan view of an alternative honeycomb pattern screen that may be used in the heating system of FIGS. 1 and 2.

Another example of a metallic mesh screen 24 is shown in FIG. 4B. In this example, two different honeycomb patterns are used including a fine honeycomb pattern 28*a* and a coarse honeycomb pattern 28*b* that is disposed in the middle of two sections having the fine honeycomb pattern 28*a*. The fine honeycomb pattern 28*a* may have the same dimensions Ax_fine as the honeycomb pattern 28 (Ax) used in the example shown in FIG. 4A. The coarse honeycomb pattern 28*b* may have apertures 26 having a size of Ax_coarse of between about 5 mm to about 10 mm (thus Bx_coarse is between about 1.67 mm and about 3.33 mm). Thus, Ax_coarse may be equal to about 2.5 times Ax_fine. The screen may have about 60% of its perforated area being the fine honeycomb pattern 28*a* and about 40% being the coarse honeycomb pattern 28*b*, which further improves the spatial distribution of the IR radiation.

Figure 7:
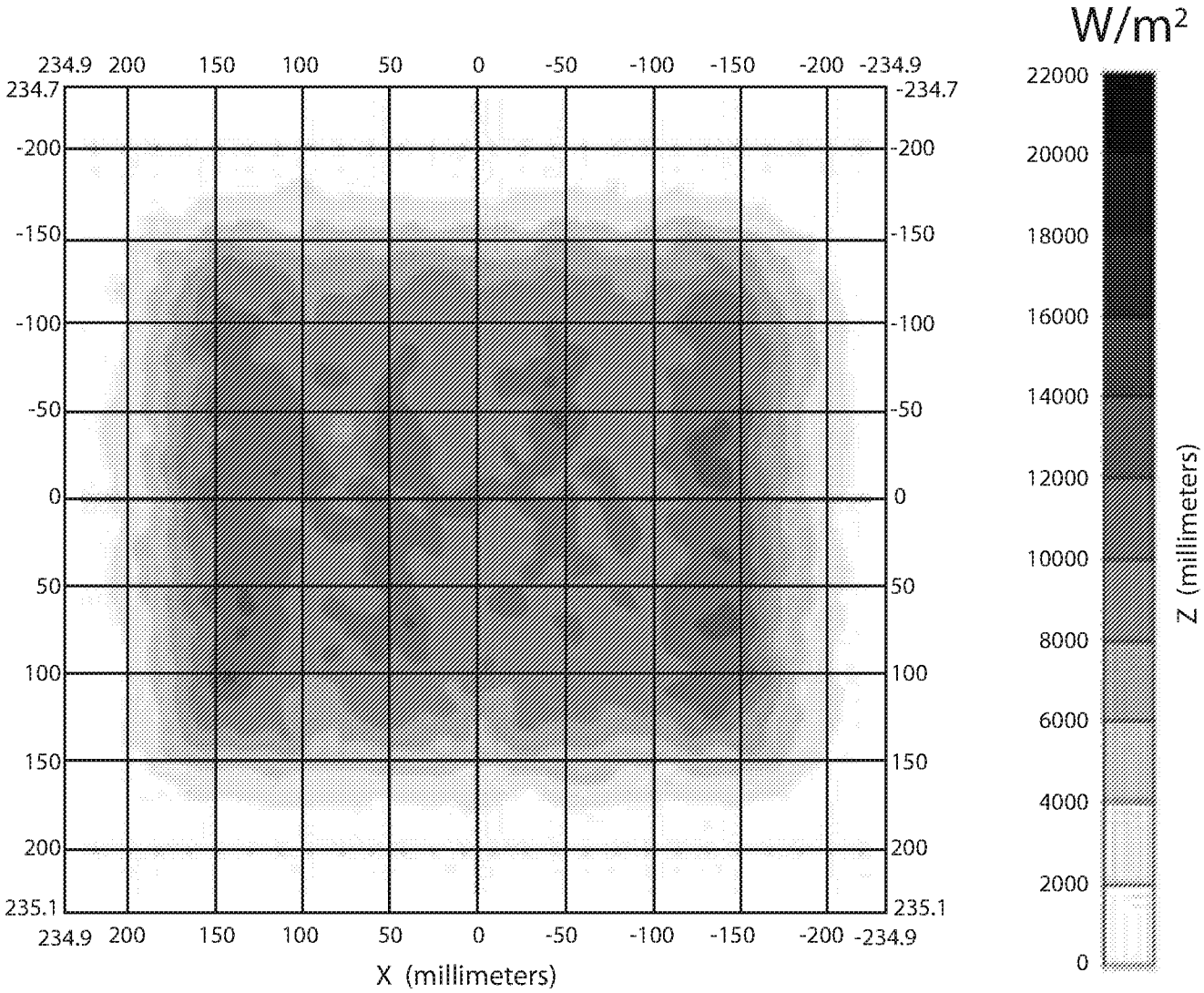
FIG. 7 is an irradiance map showing the spatial distribution of IR radiation resulting from use of the heating system of FIGS. 1 and 2 when using the honeycomb pattern screen shown in FIG. 4A.
Figure 8:
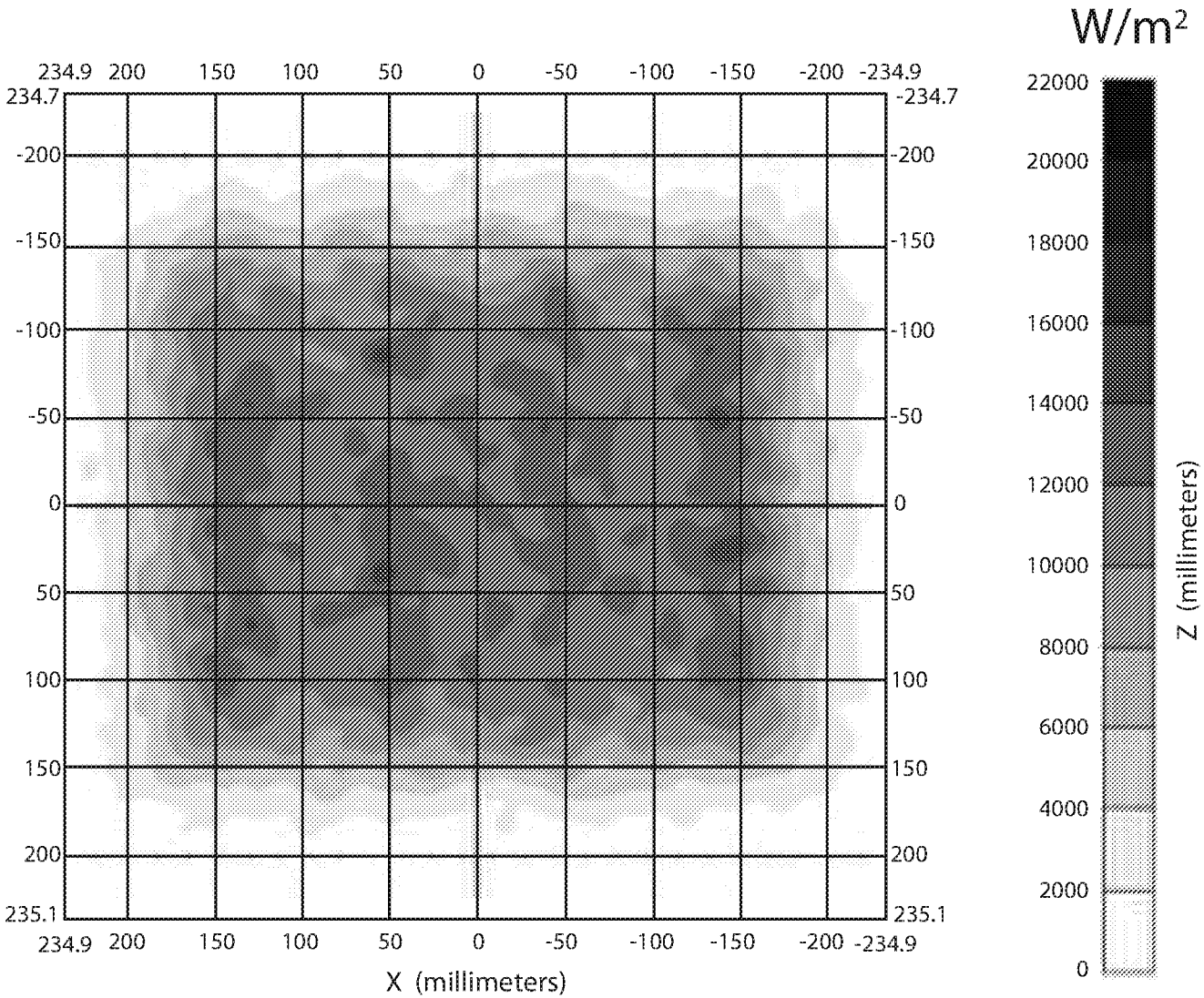
FIG. 8 is an irradiance map showing the spatial distribution of IR radiation resulting from use of the heating system of FIGS. 1 and 2 when using the honeycomb pattern screen shown in FIG. 4B.

To illustrate the extent of the spatial distribution properties of the screens 24 in FIGS. 4A and 4B, FIG. 7 is provided to show the distribution of IR radiation resulting from use of the screen 24 shown in FIG. 4A and FIG. 8 is provided to show the distribution of IR radiation resulting from use of the screen 24 shown in FIG. 4B.

The microwave sources 18*a* and 18*b* may be solid state microwave generators capable of being actuated at various frequencies, phases and amplitudes so as to create various node patterns as known in the art. Although only two microwave sources are shown, it is possible to use four or more solid state microwave generators.

It will be understood by one having ordinary skill in the art that construction of the described device and other components is not limited to any specific material. Other exemplary embodiments of the device disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the device as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present device. The exemplary structures and processes disclosed herein are for illustrative purposes and are not to be construed as limiting.

It is also to be understood that variations and modifications can be made on the aforementioned structures and methods without departing from the concepts of the present device, and further it is to be understood that such concepts are intended to be covered by the following claims unless these claims by their language expressly state otherwise.

The above description is considered that of the illustrated embodiments only. Modifications of the device will occur to those skilled in the art and to those who make or use the device. Therefore, it is understood that the embodiments shown in the drawings and described above is merely for illustrative purposes and not intended to limit the scope of the device, which is defined by the following claims as interpreted according to the principles of patent law, including the Doctrine of Equivalents.

What is claimed is:

1. A cooking apparatus comprising:

a cooking cavity for receiving food to be cooked; and a heating system positioned to heat the food disposed in the cooking cavity, the heating system comprising:

at least one IR radiation source for generating IR radiation that is projected into the cooking cavity; and a metallic mesh screen placed between the at least one IR radiation source and the cooking cavity for spatially distributing the IR radiation to uniformly project into the cooking cavity, wherein the metallic mesh screen includes a plurality of hexagonal apertures arranged in a honeycomb pattern, wherein a distance between parallel sides of each one of the hexagonal apertures is Ax and a distance between each hexagonal aperture and each adjacent hexagonal aperture is Bx, and wherein Ax is less than or equal to 3 times Bx.

2. The cooking apparatus of claim 1, wherein Ax is equal to 3 times Bx.

3. The cooking apparatus of claim 1, wherein Bx is between 0.67 mm and 1.33 mm.

4. The cooking apparatus of claim 1, wherein Ax is between 2 mm and 4 mm.

5. The cooking apparatus of claim 1, wherein the metallic mesh screen has a thickness between 1 mm and 3 mm.

6. The cooking apparatus of claim 1, wherein the honeycomb pattern includes a fine honeycomb pattern and a coarse honeycomb pattern.

7. The cooking apparatus of claim 6, wherein the fine honeycomb pattern has an aperture size of Ax_fine and the coarse honeycomb pattern has an aperture size of Ax_coarse, wherein Ax_coarse is equal to 2.5 times Ax_fine.

8. A microwave oven comprising:

the cooking apparatus of claim 1; and at least one microwave source for generating microwave energy inside the cooking cavity to cook the food.

9. The microwave oven of claim 8, wherein the at least one microwave source comprises two solid state microwave generators.

10. A microwave oven comprising:

a cooking cavity for receiving food to be cooked;

at least one microwave source for generating microwave energy inside the cooking cavity to cook the food; and a supplemental heating system positioned to heat the food disposed in the cooking cavity, the supplemental heating system comprising:

at least one IR radiation source for generating IR radiation that is projected into the cooking cavity; and a metallic mesh screen placed between the at least one IR radiation source and the cooking cavity for spatially distributing the IR radiation to uniformly project into the cooking cavity and minimizing microwave energy field losses, wherein the metallic mesh screen includes a plurality of hexagonal apertures arranged in a honeycomb pattern, wherein tea distance between parallel sides of each one of the hexagonal apertures is Ax and a distance between each hexagonal aperture and each adjacent hexagonal aperture is Bx, and wherein Ax is less than or equal to 3 times Bx.

11. The microwave oven of claim 10, wherein Ax is equal to 3 times Bx.

12. The microwave oven of claim 10, wherein Bx is between 0.67 mm and 1.33 mm.

13. The microwave oven of claim 10, wherein Ax is between 2 mm and 4 mm.

14. The microwave oven of claim 10, wherein the metallic mesh screen has a thickness between 1 mm and 3 mm.

15. The microwave oven of claim 10, wherein the honeycomb pattern includes a fine honeycomb pattern and a coarse honeycomb pattern.

16. The microwave oven of claim 15, wherein the fine honeycomb pattern has an aperture size of Ax_fine and the coarse honeycomb pattern has an aperture size of Ax_coarse, wherein Ax_coarse is equal to 2.5 times Ax_fine.

17. The microwave oven of claim 16, wherein Ax_coarse is between 5 mm and 10 mm.

18. The microwave oven of claim 10, wherein the at least one microwave source includes two solid state microwave generators.

19. The microwave oven of claim 17, a distance between each hexagonal aperture and each adjacent hexagonal aperture of the coarse honeycomb pattern is Bx_coarse, and wherein Bx_coarse is between 1.33 mm and 3.33 mm.

20. The cooking apparatus of claim 7, a distance between each hexagonal aperture and each adjacent hexagonal aperture of the coarse honeycomb pattern is Bx_coarse, and wherein Bx_coarse is between 1.33 mm and 3.33 mm.

* * * * *